US006232278B1

(12) United States Patent
Shibayama et al.

(10) Patent No.: US 6,232,278 B1
(45) Date of Patent: May 15, 2001

(54) LUBRICATING GREASE COMPOSITION

(75) Inventors: Atsushi Shibayama; Hiroshi Kimura, both of Fujisawa (JP)

(73) Assignee: Kyodo Yushi Co., Ltd., Tokyo (JP)

( * ) Notice: Subject to any disclaimer, the term of this patent is extended or adjusted under 35 U.S.C. 154(b) by 0 days.

(21) Appl. No.: 09/468,086

(22) Filed: Dec. 21, 1999

(30) Foreign Application Priority Data

Dec. 22, 1998 (JP) ..... 10-365085

(51) Int. Cl.[7] ..... C10M 117/00
(52) U.S. Cl. ..... 508/539; 508/465; 508/485
(58) Field of Search ..... 508/539

(56) References Cited

U.S. PATENT DOCUMENTS

| | | | | |
|---|---|---|---|---|
| 3,980,572 | * | 9/1976 | Dodo et al. | 508/539 |
| 3,985,662 | | 10/1976 | Campbell et al. | 508/304 |
| 4,582,616 | * | 4/1986 | Kita et al. | 508/539 |
| 4,749,502 | * | 6/1988 | Alexander et al. | 508/539 |
| 5,236,607 | * | 8/1993 | Harris et al. | 508/539 |
| 5,714,444 | | 2/1998 | Yokouchi et al. | 508/539 |

FOREIGN PATENT DOCUMENTS

| | | |
|---|---|---|
| 2 287 612 | 12/1994 | (GB) . |
| 6-330070 | 11/1994 | (JP) . |
| 8-143884 | 6/1996 | (JP) . |
| 8-209176 | 8/1996 | (JP) . |
| 8-270747 | 10/1996 | (JP) . |

* cited by examiner

*Primary Examiner*—Ellen M. McAvoy
(74) *Attorney, Agent, or Firm*—Oblon, Spivak, McClelland, Maier & Neustadt., P.C.

(57) ABSTRACT

A lubricating grease composition comprises a base oil and a thickening agent, wherein the thickening agent comprises (a) a lithium salt of hydroxystearic acid and (b) a lithium salt of a $C_6$ to $C_{14}$ fatty acid. The grease composition is useful for the improvement of the acoustic characteristics of bearings, in particular, the reduction of noise and the elongation of the service life of the bearings. Accordingly, the grease composition can be used for lubricating bearings, in particular, those used in spindle motors for the operation of recording devices such as those for computer hard disks and CD-ROM's.

15 Claims, No Drawings

LUBRICATING GREASE COMPOSITION

BACKGROUND OF THE INVENTION

1. Field of the Invention

The present invention relates to a lubricating grease composition and, in particular, to a grease composition for ball bearings.

2. Description of the Prior Art

As grease compositions used for bearings, in particular, those used in spindle motors for operating recording devices such as those for computer hard disks and CD-ROM's, there have conventionally been used, for instance, grease compositions, which comprise an ester oil such as dioctyl sebacate or a pentaerythritol ester, as a base oil and a thickening agent such as lithium stearate or lithium hydroxystearate. However, the acoustic life of these bearings has generally been insufficient. This is because the recording density of these devices has recently been increased and the increase in the recording density in turn requires the improvement of the precision of bearings and an increase in the number of revolutions of such motors. The latter would be accompanied by an increase in the temperature of bearings during practical use.

SUMMARY OF THE INVENTION

Accordingly, it is an object of the present invention to provide a lubricating grease composition, which is useful for the improvement of the acoustic characteristics of bearings, in particular, the reduction of noise and the elongation of the service life of the bearings.

According to an aspect of the present invention, there is provided a lubricating grease composition, which comprises a base oil and a thickening agent, wherein the thickening agent comprises (a) a lithium salt of hydroxystearic acid and (b) a lithium salt of a $C_6$ to $C_{14}$ fatty acid.

DESCRIPTION OF THE PREFERRED EMBODIMENTS

The inventors of this invention have found that the foregoing object of the present invention can effectively be accomplished by the use of a soap having a quite uniform fibrous structure, as a thickening agent. Such a soap having a quite uniform fibrous structure can be formed by the simultaneous use of (a) a lithium salt of hydroxystearic acid (such as 12-hydroxystearic acid) and (b) a lithium salt of a $C_6$ to $C_{14}$ fatty acid.

In this respect, hydroxystearic acid and $C_6$ to $C_{14}$ fatty acids may, in general, be commercially available and they are put on the market in the form of products having various degrees of purity. Those having low purity comprise fatty acids and unsaturated fatty acids, whose carbon atom number differs from each other. In this respect, if the content of fatty acids other than the desired ones is high in a commercially available product, the grease composition obtained using such a product has characteristic properties, which vary widely. Thus, the present invention employs, as the hydroxystearic acid (for instance, 12-hydroxystearic acid) and the $C_6$ to $C_{14}$ fatty acid, the purity each of which is not less than 80% (% by weight) to eliminate the foregoing drawbacks.

The lithium salt of fatty acid used in the invention as the foregoing component (b) has a carbon atom number ranging from 6 to 14. This is because a lithium salt of fatty acid used herein having a carbon atom number of not more than 5 has a low solubility in the base oil and accordingly, it is necessary to heat the resulting soap to a temperature of not less than 260° C. to thus solubilize the same. However, most of the base oils used in the invention has a flash point lower than that temperature and therefore, there is a danger of catching a fire during the preparation of the grease composition. On the other hand, a lithium salt of fatty acid selected having a carbon atom number of not less than 15 is quite similar to those observed for the lithium salt of hydroxystearic acid as the principal fatty acid component and therefore, the addition thereof cannot ensure any conspicuous effect of the simultaneous use of these two components or it is not necessary to daringly incorporate it into the grease composition. In particular, if the carbon atom number of the fatty acid exceeds 20, the solubility thereof in the base oil is extremely high, it does not ensure a desired thickening effect at all, and the amount of the soap required for achieving a desired penetration is increased to a considerably high level as compared with that required when the lithium salt of hydroxystearic acid is used alone (i.e., 100%). This in turn leads to an increase in the production cost.

In the lubrication grease composition of the invention, the molar ratio of the lithium hydroxystearic acid (a) to the lithium salt of $C_6$ to $C_{14}$ fatty acid (b) preferably ranges from 5:95 to 95:5 and more preferably 10:90 to 95:5.

The base oil used in the lubricating grease composition preferably has a kinematic viscosity, as determined at 40° C., ranging from 5 to 200 $mm^2/s$ and more preferably 10 to 100 $mm^2/s$.

Examples of the base oils usable in the lubricating grease composition of the invention include ester type synthetic oils such as carboxylic acid ester compounds and polyol ester oils; ether type synthetic oils such as alkyl diphenyl ethers; synthetic hydrocarbon oils such as poly(α-olefin) type oils; and mineral oils such as paraffinic mineral oils.

Among these base oils, particularly preferred are those comprising ester oils in an amount of not less than 10% by mass and more preferably not less than 50% by mass based on the total mass of the base oil.

The content of the thickening agent in the lubricating grease composition preferably ranges from 5 to 40% by mass and more preferably 7 to 20% by mass on the basis of the total amount of the grease composition.

As has been described above in detail, the grease composition of the present invention is useful for the improvement of the acoustic characteristics of bearings, in particular, the reduction of noise and the elongation of the service life of the bearings. Accordingly, the grease composition can be used for lubricating bearings, in particular, those used in spindle motors for operating recording devices such as those for computer hard disks and CD-ROM's.

The present invention will be described in more detail with reference to the following Examples, but the present invention is not restricted to these specific Examples at all.

EXAMPLE 1

In this Example, a pentaerythritol ester oil (kinematic viscosity as determined at 40° C.: 33 $mm^2/s$) was used as a base oil and a fatty acid was reacted with lithium hydroxide in the base oil as will be detailed below to give a grease composition (200 g each). The amount of the fatty acid was set at 10% by mass and that of lithium hydroxide was adjusted in such a manner that the amount thereof was 5% higher than the saponification value practically determined. The fatty acid used herein had a purity of not less than 80%. The process used for preparing the grease composition was as follows:

a) A base oil was mixed with a fatty acid in a beaker, followed by heating the mixture to about 80° C. to thus solubilize the latter in the base oil and to form a solution A;

b) Lithium hydroxide was mixed with 5 times of distilled water in a beaker and then the beaker was heated to about 80° C. to give a solution B;

c) The solution B was introduced into the solution A at a breath and they were reacted with one another for about 5 minutes; and d) After the completion of the reaction, the reaction system was heated to dissolve the resulting soap in the base oil (maximum temperature: 235° C.), followed by allowing the system to stand to cool the reaction system to room temperature and once passing it though a three-roll mill (clearance: 10 to 20 $\mu$m) to knead the same and to thus give a desired grease composition.

EXAMPLE 2

A pentaerythritol ester oil (kinematic viscosity as determined at 40° C.: 33 $mm^2/s$) was used as a base oil and grease compositions (200 g each) were prepared by the method detailed below. The content of the soap in the grease composition was adjusted to 10% by mass.

a) A base oil and a lithium soap were dispensed into a single beaker and the mixture was heated to 235° C.; and b) After the dissolution of the soap in the base oil, the resulting solution was allowed to stand to cool the same down to room temperature and then once passed through a three-roll mill (clearance: 10 to 20 $\mu$m) to give each desired grease composition.

The lubricating grease compositions prepared in the foregoing Examples 1 and 2 were inspected for the characteristic properties by the following methods:

Acoustic Life Testing Method

The following bearing was operated for a predetermined period of time under conditions specified below, using each grease composition, then the level of Anderon (quantity of sound) and the magnitude of noise were determined using an Anderon tester (AD-SN-4 available from Sugawara Kenkyusho Co., Ltd.). The results were evaluated by points based on the magnitude of noise and Anderon levels thus determined, and compared with those observed for a standard product (Sample 10 of Comparative Example 1, Sample 11 of Comparative Example 2 or Sample 16 of Reference Example).

(1) Test Conditions: Bearing used: 608 VV; test temperature: 100° C.; number of revolutions: 1800 rpm; testing time: 500 hours; and amount of filled grease: 0.35 ml (corresponding to about 40% of the dead volume of the bearing).

(2) Anderon Test (determination of the level of Anderon and the magnitude of noise): These quantities were determined at a number of revolutions of 1800 rpm; and a testing time of 120 sec.

Evaluation: The grease compositions were evaluated according to the following criteria, with respect to the standard product:

A: A grease composition, which has a point greater than 1.1 times that observed for the standard product;

B: A grease composition, which has a point ranging from 0.9 to 1.1 times that observed for the standard product; and C: A grease composition, which has a point of less than 0.9 time that observed for the standard product.

Method for Confirming the Length and Width of Soap Fibers

The length and width of soap fibers were determined by observation under an electron microscope (LEM-2000 available from Akashi Seisakusho Co., Ltd.).

The resulting grease sample was diluted 5 to 20 times with vaseline and the diluted sample was applied onto a metal mesh for the electron microscopic observation. Then the metal mesh was put in a glass dish filled with a solvent (such as n-hexane) to thus remove the oil components from the grease sample. The metal mesh was withdrawn from the glass dish, dried and fitted to the electron microscope for the observation of soap fibers. The magnification of the microscope was adjusted to ×6000, followed by selection of 5 fibers among those having a typical size and mainly constituting the soap present in one visual field to determine the lengths and widths thereof and determination of the average of these measured values.

The results thus obtained are summarized in the following Tables.

TABLE 1

| | Samples of Example 1 | | | | | | | | |
|---|---|---|---|---|---|---|---|---|---|
| | 1 | 2 | 3 | 4 | 5 | 6 | 7 | 8 | 9 |
| Principal Fatty Acid | | | | | | | | | |
| Hydroxystearic acid | 70 | 70 | 50 | 95 | 70 | 30 | 70 | 80 | 70 |
| Auxiliary Fatty Acid | | | | | | | | | |
| Caproic acid (C6) | 30 | — | — | — | — | — | — | — | — |
| Caprylic acid (C8) | — | 30 | 50 | 5 | — | 70 | — | — | — |

TABLE 1-continued

| | Samples of Example 1 | | | | | | | | |
|---|---|---|---|---|---|---|---|---|---|
| | 1 | 2 | 3 | 4 | 5 | 6 | 7 | 8 | 9 |
| Capric acid (C10) | — | — | — | — | 30 | — | — | — | — |
| Lauric acid (C12) | — | — | — | — | — | — | 30 | 20 | — |
| Myristic acid (C14) | — | — | — | — | — | — | — | — | 30 |
| Worked Penetration | 197 | 193 | 196 | 200 | 192 | 232 | 198 | 206 | 200 |
| Dropping Point (° C.) | 217 | 209 | 212 | 205 | 207 | 216 | 203 | — | 200 |
| Acoustic Life | A | A | A | A | A | A | A | A | A |
| Length of Fiber (μm) | 0.45 | 0.68 | 0.55 | 0.95 | 0.88 | 0.59 | 0.94 | 0.92 | 1.05 |
| Width of Fiber (μm) | 0.03 | 0.03 | 0.03 | 0.03 | 0.03 | 0.03 | 0.03 | 0.03 | 0.03 |

TABLE 2

| | Samples of Comparative Example 1 | | |
|---|---|---|---|
| | 10 | 11 | 12 |
| Principal Fatty Acid | | | |
| Hydroxystearic acid | 100 | 70 | 70 |
| Auxiliary Fatty Acid | | | |
| Caprylic acid (C8) | — | — | — |
| Palmitic acid (C16) | — | — | 30 |
| Acetic acid (C2) | — | 30 | — |
| Worked Penetration | 219 | — | 205 |
| Dropping Point (° C.) | 196 | — | 198 |
| Acoustic Life | B | — | B |
| Length of Fiber (μm) | 1.84 | 0.25 | 1.75 |
| Width of Fiber (μm) | 0.05 | 0.01 | 0.05 |

The symbol "—" appearing in the columns entitled "Worked Penetration", "Dropping Point" and "Acoustic Life" means that the corresponding sample was not inspected for these properties.

The hydroxystearic acid used in Example 1 and Comparative Example 1 is 12-hydroxystearic acid (purity: 85%). In addition, other fatty acids used have a purity of not less than 90%.

Regarding the size of the soap fiber, the samples 1 to 9 and 11 were thin and short as compared with the fibers of the sample 10, while the sample 12 had a size similar to that of the sample 10.

TABLE 3-1

| | Samples of Example 2 | | | | |
|---|---|---|---|---|---|
| | 1 | 2 | 3 | 4 | 5 |
| Principal Soap | | | | | |
| Li salt of hydroxystearic acid | 70 | 70 | 70 | 50 | 30 |
| Auxiliary Soap | | | | | |
| Li salt of caproic acid (C6) | 30 | — | — | — | — |
| Li salt of caprylic acid (C8) | — | 30 | — | — | — |

TABLE 3-1-continued

| | Samples of Example 2 | | | | |
|---|---|---|---|---|---|
| | 1 | 2 | 3 | 4 | 5 |
| Li salt of capric acid (C10) | — | — | 30 | 50 | 70 |
| Li salt of lauric acid (C12) | — | — | — | — | — |
| Li salt of myristic acid (C14) | — | — | — | — | — |
| Worked Penetration | 221 | 213 | 209 | 202 | 203 |
| Acoustic Life | A | A | A | A | A |
| Length of Fiber (μm) | 0.65 | 0.84 | 0.86 | 0.68 | 0.85 |
| Width of Fiber (μm) | 0.02 | 0.03 | 0.03 | 0.02 | 0.02 |

TABLE 3-2

| | Samples of Example 2 | | | | |
|---|---|---|---|---|---|
| | 6 | 7 | 8 | 9 | 10 |
| Principal Soap | | | | | |
| Li salt of hydroxystearic acid | 10 | 95 | 70 | 70 | 70 |
| Auxiliary Soap | | | | | |
| Li salt of caproic acid (C6) | — | — | — | — | — |
| Li salt of caprylic acid (C8) | — | — | — | — | 15 |
| Li salt of capric acid (C10) | 90 | 5 | — | — | 15 |
| Li salt of lauric acid (C12) | — | — | 30 | — | — |
| Li salt of myristic acid (C14) | — | — | — | 30 | — |
| Worked Penetration | 265 | 206 | 212 | 204 | 204 |
| Acoustic Life | A | A | A | A | A |
| Length of Fiber (μm) | 0.90 | 0.75 | 0.90 | 1.08 | 0.94 |
| Width of Fiber (μm) | 0.02 | 0.05 | 0.03 | 0.03 | 0.03 |

TABLE 4

| | Samples of Comparative Example 2 | | | | | |
|---|---|---|---|---|---|---|
| | 11 | 12 | 13 | 14 | 15 | 16* |
| Principal Soap | | | | | | |
| Li salt of hydroxystearic acid | 100 | 70 | 70 | 70 | 0 | 100 |
| Auxiliary Soap | | | | | | |
| Li salt of capric acid (C10) | — | — | — | — | 100 | — |
| Li salt of stearic acid (C18) | — | — | 30 | — | — | — |
| Li salt of behenic acid (C22) | — | — | — | 30 | — | — |
| Li salt of acetic acid (C2) | — | 30 | — | — | — | — |
| Worked Penetration | 221 | — | 221 | 273 | 437 | 250 |
| Acoustic Life | B | — | B | C | — | B |
| Length of Fiber ($\mu$m) | 1.70 | — | 1.55 | 1.86 | 2.63 | 1.60 |
| Width of Fiber ($\mu$m) | 0.05 | — | 0.05 | 0.05 | 0.16 | 0.05 |

*Reference Example

The symbol "—" appearing in the columns entitled "Worked Penetration" and "Acoustic Life" means that the corresponding sample was not inspected for these properties.

The lithium hydroxystearate used in Example 2 and Comparative Example 2 is lithium 12-hydroxystearate (purity: 85%). In addition, other fatty acids used have a purity of not less than 90%.

The sample of Reference Example 16 was prepared using lithium 12-hydroxystearate having a purity of about 70% and a 80:20 (weight ratio) mixture of pentaerythritol ester oil and a diester oil as the base oil. The kinematic viscosity of the base oil was 26.0 $mm^2/s$ at 40° C. and the dropping point of the grease composition was found to be 190° C.

Regarding the size of the soap fiber, the samples 1 to 10 were thin and short as compared with the fibers of the sample 11, while the samples 13 to 16 had a size similar to or greater than that of the sample 11.

What is claimed is:

1. A lubricating grease composition, comprising:

a base oil; and a thickening agent;

wherein the thickening agent comprises (a) a lithium salt of hydroxystearic acid and (b) a lithium salt of a $C_6$ to $C_{10}$ fatty acid.

2. The lubricating grease composition of claim 1, wherein a molar ratio of the lithium salt of hydroxystearic acid to the lithium salt of the $C_6$ to $C_{10}$ fatty acid ranges from 5:95 to 95:5.

3. The lubricating grease composition of claim 1, wherein said base oil has a kinematic viscosity of from 5 to 200 $mm^2/s$ as determined at 40° C.

4. The lubricating grease composition of claim 1, wherein a molar ratio of the lithium salt of hydroxystearic acid to the lithium salt of the $C_6$ to $C_{10}$ fatty acid ranges from 5:95 to 95:5 and the kinematic viscosity of the base oil ranges from 5 to 200 $mm^2/s$ as determined at 40° C.

5. The lubricating grease composition of claim 1, wherein said base oil comprises not less than 10% by weight of an ester oil.

6.The lubricating grease composition of claim 1, wherein a molar ratio of the lithium salt of hydroxystearic acid to the lithium salt of the $C_6$ to $C_{10}$ fatty acid ranges from 5:95 to 95:5 and the base oil comprises not less than 10% by weight of an ester oil.

7. The lubricating grease composition of claim 1, wherein said base oil has a kinematic viscosity of from 5 to 200 $mm^2/s$ as determined at 40° C.; and wherein the base oil comprises not less than 10% by weight of an ester oil.

8. The lubricating grease composition of claim 1, wherein a content of the thickening agent ranges from 5 to 40% by weight based on the total weight of the composition.

9. The lubricating grease composition of claim 1, wherein a molar ratio of the lithium salt of hydroxystearic acid to the lithium salt of the $C_6$ to $C_{10}$ fatty acid ranges from 5:95 to 95:5 and a content of the thickening agent ranges from 5 to 40% by weight based on the total weight of the composition.

10. The lubricating grease composition of claim 1, wherein said base oil has a kinematic viscosity of from 5 to 200 $mm^2/s$ as determined at 40° C.; and wherein a content of the thickening agent ranges from 5 to 40% by weight based on the total weight of the composition.

11. The lubricating grease composition of claim 1, wherein the base oil comprises not less than 10% by weight of an ester oil and a content of the thickening agent ranges from 5 to 40% by weight based on the total weight of the composition.

12. The lubricating grease composition of claim 1, wherein the molar ratio of the lithium salt of hydroxystearic acid to the lithium salt of the $C_6$ to $C_{10}$ fatty acid ranges from 5:95 to 95:5;

wherein said base oil has a kinematic viscosity of from 5 to 200 $mm^2/s$ as determined at 40° C.; and wherein the base oil comprises not less than 10% by weight of an ester oil.

13. The lubricating grease composition of claim 1, wherein a molar ratio of the lithium salt of hydroxystearic acid to the lithium salt of the $C_6$ to $C_{14}$ fatty acid ranges from 5:95 to 95:5;

wherein said base oil has a kinematic viscosity of from 5 to 200 $mm^2/s$ as determined at 40° C.;

wherein the base oil comprises not less than 10% by weight of an ester oil; and wherein a content of the thickening agent ranges from 5 to 40% by weight based on the total weight of the composition.

14. The lubricating grease composition of claim 1, wherein said composition has the form of a fiber, and wherein a length of said fiber is 0.45–0.95 $\mu$m.

15. The lubricating grease composition of claim 1, wherein said composition has the form of a fiber; and wherein a width of said fiber is 0.02–0.03 $\mu$m.

* * * * *